US011803158B2

(12) United States Patent
Vuille et al.

(10) Patent No.: US 11,803,158 B2
(45) Date of Patent: Oct. 31, 2023

(54) CLOSING/OPENING SYSTEM FOR A TIMEPIECE CASE

(71) Applicant: The Swatch Group Research and Development Ltd, Marin (CH)

(72) Inventors: Pierry Vuille, Les Emibois (CH); Enzo Agustoni, Marin (CH); Joel Allimann, Vallon (CH); Francois Erdemli, Colombier (CH)

(73) Assignee: The Swatch Group Research and Development Ltd, Marin (CH)

( * ) Notice: Subject to any disclaimer, the term of this patent is extended or adjusted under 35 U.S.C. 154(b) by 711 days.

(21) Appl. No.: 16/767,409

(22) PCT Filed: Nov. 19, 2018

(86) PCT No.: PCT/EP2018/081802
§ 371 (c)(1),
(2) Date: May 27, 2020

(87) PCT Pub. No.: WO2019/115170
PCT Pub. Date: Jun. 20, 2019

(65) Prior Publication Data

US 2020/0387112 A1 Dec. 10, 2020

(30) Foreign Application Priority Data

Dec. 15, 2017 (EP) ..... 17207783

(51) Int. Cl.
*G04B 37/08* (2006.01)
*G04B 37/00* (2006.01)

(52) U.S. Cl.
CPC ..... *G04B 37/084* (2013.01); *G04B 37/0033* (2013.01); *G04B 37/0041* (2013.01)

(58) Field of Classification Search
CPC ..... G04B 37/0041; G04B 37/0033; G04B 37/084; G04B 37/0008; G04B 45/0084; G04B 37/11; G04B 37/116; G04B 37/05
See application file for complete search history.

(56) References Cited

U.S. PATENT DOCUMENTS 3,722,208 A 3/1973 Ryser
3,729,924 A * 5/1973 Aoki ..... G04B 39/02 368/291

(Continued)

FOREIGN PATENT DOCUMENTS

CH 213643 A 2/1941
CH 297482 3/1954

(Continued)

OTHER PUBLICATIONS

Office Action dated Jul. 29, 2021 in corresponding Korean Patent Application No. 10-2020-7016289 (with English Translation), 10 pages.

(Continued)

*Primary Examiner* — Edwin A. Leon
(74) *Attorney, Agent, or Firm* — Oblon, McClelland, Maier & Neustadt, L.L.P.

(57) ABSTRACT

A closing/opening system for a case of a timepiece is defined particularly in first and second parts of the case. The system includes a device for producing a mechanical connection, particularly a bayonet connection between these first and second parts and a device for creating a friction torque between these first and second parts. The device for creating a friction torque includes tightening faces to cooperate with one another when closing/opening the case and which are defined in the first and second parts. The system further includes a tightening element in one of these two tightening faces. The tightening element generates a constant friction (Continued)

torque during a course of travel of one of the two parts relative to the other when closing/opening the case of the timepiece.

20 Claims, 2 Drawing Sheets

(56) References Cited

U.S. PATENT DOCUMENTS

| | | | | |
|---|---|---|---|---|
| 4,218,873 | A | 8/1980 | Lang | |
| 4,379,643 | A | 4/1983 | Halicho | |
| 4,440,505 | A * | 4/1984 | Gogniat | G04B 37/0058 368/300 |
| 4,967,402 | A * | 10/1990 | Claude | G04B 37/11 368/300 |
| 2003/0227829 | A1 | 12/2003 | Megner et al. | |
| 2008/0043577 | A1 | 2/2008 | Mavilla et al. | |

FOREIGN PATENT DOCUMENTS

| | | | |
|---|---|---|---|
| CH | 357351 | A | 9/1961 |
| CH | 8 538/71 | | 12/1974 |
| CN | 1048108 | A | 12/1990 |
| CN | 1363863 | A | 8/2002 |
| CN | 1991639 | A | 7/2007 |
| CN | 101114159 | A | 1/2008 |
| CN | 101126914 | A | 2/2008 |
| CN | 201599350 | U | 10/2010 |
| CN | 105814497 | A | 7/2016 |
| CN | 206301158 | U | 7/2017 |
| CN | 107193199 | A | 9/2017 |
| CN | 206584167 | U | 10/2017 |
| EP | 2 328 044 | A1 | 6/2011 |
| EP | 2 874 022 | B1 | 11/2013 |
| EP | 2 874 022 | A1 | 5/2015 |
| JP | 56-8584 | A | 1/1981 |
| JP | 2002-41182 | A | 2/2002 |
| JP | 2017-507333 | A | 3/2017 |
| WO | WO 2015/071719 | A2 | 5/2015 |

OTHER PUBLICATIONS

International Search Report dated Feb. 1, 2019 in PCT/EP2018/081802 filed Nov. 19, 2018, 2 pages.

Japanese Office Action dated May 28, 2021 in Japanese Patent Application No. 2020-545862 (with unedited computer generated English translation), 11 pages.

Combined Chinese Office Action and Search Report dated Feb. 10, 2021 in Chinese Patent Application No. 201880080974.1 (with English translation), 16 pages.

Combined Chinese Office Action and Search Report dated Mar. 21, 2022 in Chinese Patent Application No. 201880080974.1 (with English translation), 18 pages.

* cited by examiner

CLOSING/OPENING SYSTEM FOR A TIMEPIECE CASE

CROSS-REFERENCE TO RELATED APPLICATION

The present application claims priority to European Patent Application No. 17207783.6, filed on Dec. 15, 2017, the entire content and disclosure of which are incorporated by reference herein.

FIELD OF THE INVENTION

The invention relates to a closing/opening system for a case of a timepiece, as well as to such a timepiece case provided with this system.

The invention further relates to a timepiece comprising such a case.

BACKGROUND OF THE INVENTION

In the prior art, timepieces comprise a case provided with a closing/opening system that plays a role in assembling/disassembling a back with a middle part of this case. Such a system conventionally comprises a bayonet connection device and a gasket generally arranged in a recess defined in this middle part. In this configuration, when assembling the back onto the middle part, the gasket is gradually compressed by this back during the course of travel thereof relative to the middle part in order to produce a tight closing of this case, by creating a tightening torque.

However, one of the drawbacks of such a closing/opening system of the case lies in the fact that this gasket does not contribute to providing a tightening/loosening torque which secures the assembly/disassembly of the back with the middle part. More specifically, in this braking system, the gasket contributes to providing a gradual tightening/loosening torque which is in the order of 0.7 N·m for an opening diameter of the middle part of 40 mm, whereas a tightening/loosening torque must be equal to about 3 N·m for such a diameter in order to secure the assembly/disassembly of the back with the middle part. Moreover, it should be noted that in such a system, this tightening/loosening torque is limited by the assembly tolerances of this gasket in the middle part.

SUMMARY OF THE INVENTION

The purpose of the present invention is to overcome in full or in part the aforementioned drawbacks by proposing a timepiece comprising a case provided with a closing/opening system which allows the assembly/disassembly of parts such as a back and a middle part of this case to be secured.

For this purpose, the invention relates to a closing/opening system for a case of a timepiece, defined particularly in first and second parts of said case, the system comprising a device for producing a mechanical connection, particularly a bayonet connection between these first and second parts and a device for creating a friction torque between these first and second parts, the device for creating a friction torque including tightening faces configured to cooperate with one another when closing/opening the case and which are defined in said first and second parts, the system comprising a tightening element comprised in one of these two tightening faces, said tightening element being configured to generate a constant friction torque during a course of travel of one of the two parts relative to the other when closing/opening the case of the timepiece.

In other embodiments:

- the system comprises a resiliently compressible element comprised in the same tightening face as the tightening element, said resiliently compressible element being intended to be compressed between these first and second parts;
- the resiliently compressible element and the tightening element project from the tightening face, in particular from a recess defined in this tightening face in which they are both comprised;
- the resiliently compressible element and the tightening element each have an appreciably circular shape;
- the resiliently compressible element has a diameter that is greater than the diameter of the tightening element;
- the resiliently compressible element has a thickness that is less than a thickness of the tightening element, said thicknesses being greater than a depth of the recess;
- the resiliently compressible element and the tightening element are arranged in said tightening face such that they are concentric or coaxial to one another;
- the device for producing a mechanical connection comprises connecting faces defined in the first and second parts contributing to ensuring the mechanical connection between these parts;
- the connecting faces respectively comprise at least one groove and at least one tab capable of cooperating with one another when closing/opening the case;
- the connecting face comprising said groove includes a guide area intended to guide the tab towards an inlet of this groove when closing the case;
- the groove comprises said inlet and a bottom, separated by a distance defining an angular course of travel of one of the first and second parts relative to the other;
- the groove comprises a guide area intended to direct the tab so as to cause a constant stressing force to be applied to the tightening element resulting from the cooperation of the tightening faces with one another when closing/opening the case;
- the tightening face and the connecting face of a same first or second part are perpendicular or substantially perpendicular to one another;
- the tightening element is a ring, in particular made of a polymer and the resiliently compressible element is a gasket, in particular an O-ring;
- the first part is a middle part and the second part is a back of the case.

The invention further relates to a case of a timepiece comprising such a closing/opening system.

The invention further relates to a timepiece comprising such a watch case.

Thus, thanks to these features, the closing/opening system of the case comprising such a tightening element contributes to producing a constant, secure tightening/loosening torque between these two parts of the case, for example a back and a middle part of this case, over an entire course of travel for assembling/disassembling one of these two parts relative to the other.

BRIEF DESCRIPTION OF THE DRAWINGS

Other specific features and advantages will be clearly observed in the following description, which is given as a rough guide and in no way as a limited guide, with reference to the accompanying figures, wherein.

DETAILED DESCRIPTION OF THE PREFERRED EMBODIMENTS

Figure 1:
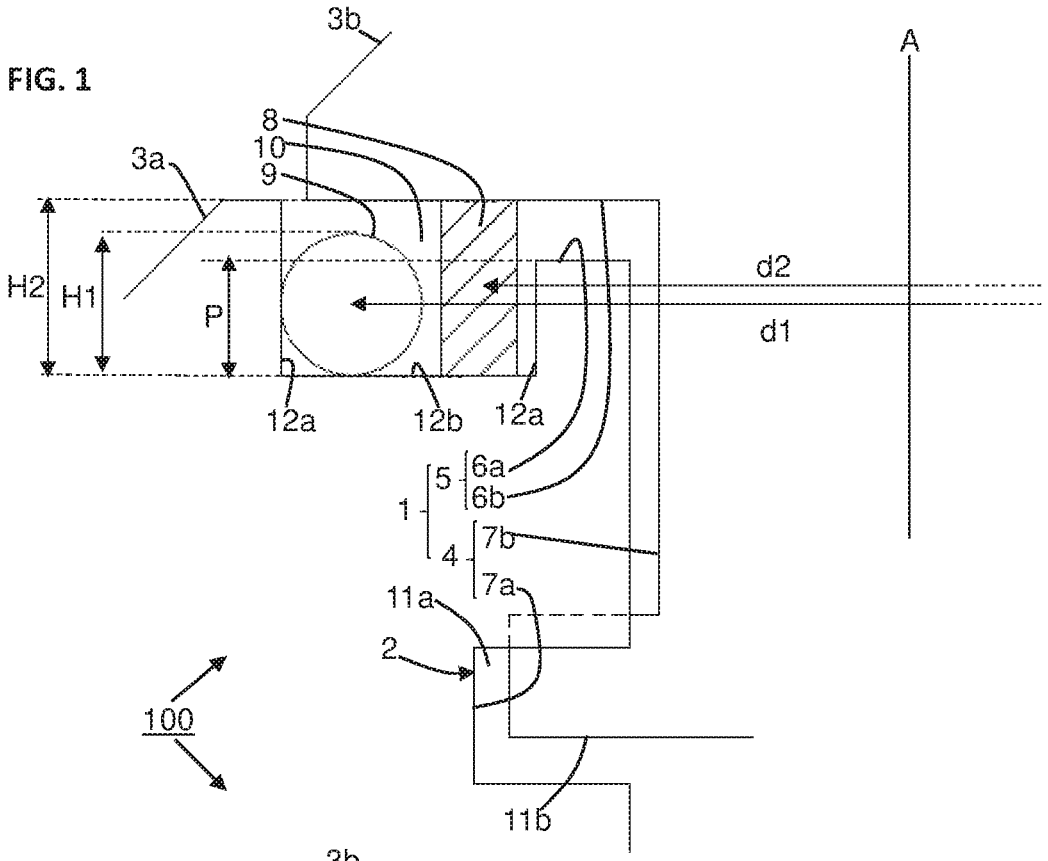
FIG. 1 is a diagrammatic, sectional view of one part of a case of a timepiece, a closing/opening system whereof is in an open configuration, according to one embodiment of the invention.
Figure 2:
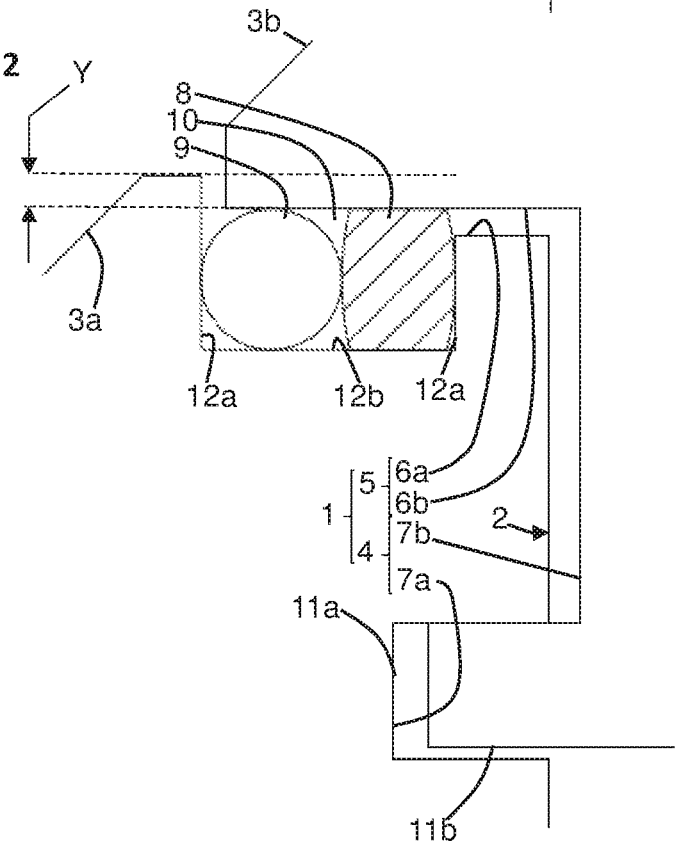
FIG. 2 is a diagrammatic, sectional view of the part of the case of the timepiece, the closing/opening system whereof is in a closed configuration, according to the embodiment of the invention.
Figure 3:
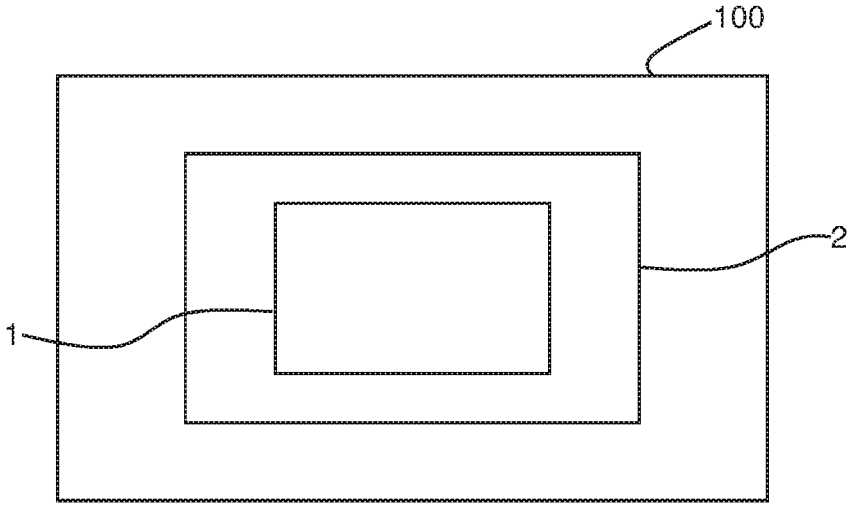
FIG. 3 is a diagrammatic view of the timepiece according to the embodiment of the invention.

With reference to FIGS. 1 to 3, the invention relates to a timepiece 100 such as a watch comprising a case 2 provided with a closing/opening system 1 defined in a first part and a second part 3*a*, 3*b* of said case 2, one whereof is preferably removable 2. More specifically, this closing/opening system 1 is capable of being set to an open or closed configuration for the purpose of opening or closing the case 2 by assembling/disassembling these first and second parts 3*a*, 3*b*. This system 1 comprises a device for producing a mechanical connection 4, in particular a bayonet connection between these first and second parts 3*a*, 3*b*, as well as a device for creating a friction torque 5 between the latter 3*a*, 3*b*. The devices for producing a mechanical connection 4 and for creating a friction torque 5 are both separate devices of the system 1. These devices 4, 5 are configured to carry out different functions when closing/opening the watch case 2. Furthermore, it should be noted that these two devices 4, 5 are formed by different elements/parts of the timepiece 100.

In this timepiece 100, the case 2 has, in a non-limiting and non-exhaustive manner, a circular shape and comprises a middle part or a middle-bezel which is closed at a top face by a crystal and at a bottom face by a removable back. The crystal is, in this case, disposed above a dial in particular for displaying the time by means of hands driven by a horological movement. The dial can further comprise a window for a digital or alphanumerical display. The timepiece 100 can be placed around the wrist by means of two bracelet strands attached to the case 2 and joined by a clasp of a known type.

In the present embodiment of the invention, the first and second parts 3*a*, 3*b* correspond, for example, respectively to the middle part and to the removable bottom which can be assembled with one another in a removable and/or reversible manner as specified hereinabove using a bayonet connection. These first and second parts 3*a*, 3*b* are intended to be moved in rotation about a rotational axis A within the scope of the assembly or disassembly thereof, over a course of travel describing an angle that is preferably acute, which can, for example, lie in the range 15 to 45 degrees, and which is preferably 40 degrees.

It should be noted that this course of travel can also be referred to as the angular course of travel or angular course of tightening/loosening or even the angular course of assembly/disassembly of these two parts 3*a*, 3*b*. In this context, this rotational axis A passes through these two parts 3*a*, 3*b* at the centre thereof while being perpendicular thereto. This middle part 3*a* thus assembled with this back 3*b* defines an enclosure of the case 2 wherein the movement is in particular mounted.

In this system 1, the device for creating a friction torque 5 comprises tightening faces 6*a*, 6*b* which are defined in the first and second parts 3*a*, 3*b* and one of these tightening faces 6*a*, 6*b* whereof is provided with a tightening element 8 visible in FIGS. 1 and 2. These tightening faces 6*a*, 6*b* are arranged facing one another and are intended to cooperate with one another in order to create a friction torque between these first and second parts 3*a*, 3*b* so as to thus configure the friction torque required for the secure assembly/disassembly of the two parts 3*a*, 3*b* thereof with one another when closing/opening the case 2. This friction torque, also referred to as the secure friction torque or even as the secure tightening/loosening torque, is a torque that is constant throughout the entire course of travel taken by one of the two parts 3*a*, 3*b* relative to the other. In this context, it is understood that the tightening element 8 is configured such that it generates a constant friction torque during a course of travel of one of the two parts 3*a*, 3*b* relative to the other when closing/opening the case 2 of the timepiece. In other words, this tightening element 8 is intended to generate a constant friction torque between parts that must be rigid of the timepiece 100 such as the tightening faces 6*a*, 6*b* of each of the first and second parts 3*a*, 3*b*, in particular in order to procure a secure closing/opening of the case 2 of the timepiece 100.

As stated, one of the two tightening faces 6*a*, 6*b* comprises the tightening element 8. In the present embodiment, this tightening face 6*a* is defined in the first part 3*a*, in this case the middle part. This tightening face 6*a* of the middle part 3*a* comprises a recess 10 wherein a resiliently compressible element 9 and this tightening element 8 are arranged. This resiliently compressible element 9 is a gasket, in particular an O-ring. Such a resiliently compressible element 9 is thus preferably a gasket having a circular section which is intended to be compressed between the first and second parts 3*a*, 3*b* in order to prevent water infiltrations between these two parts 3*a*, 3*b*. Such an element 9 thus ensures interstitial leak tightness of the case 2 and contributes to improving the service life thereof. The tightening element 8 can, for example, comprise a ring, in particular made of polymer, in particular Asutane, which is a material marketed by the company Asulab SA, Marin, Switzerland. This ring is thus preferably not threaded since such a mechanical connection with one of the two parts 3*a*, 3*b* of the timepiece 100 is not compatible with the expected function of this element 8, which is in particular the generation of a constant friction torque between these two parts 3*a*, 3*b*. This tightening element 8 is, for example, a one-piece part but can also be formed by a plurality of parts engaging with one another when closing/opening the case 2. This tightening element 8 comprises contact faces intended to cooperate with the tightening faces 6*a*, 6*b* of each of the first and second parts 3*a*, 3*b*. Such a tightening element 8 has structural features/properties that are specifically defined for procuring cooperation with the rigid parts of the timepiece 100, such as the tightening faces 6*a*, 6*b* of each of the first and second parts 3*a*, 3*b*. More specifically, such a tightening element 8 is preferably not adapted to cooperate with flexible or deformable parts or elements of the timepiece 100. The dimensions of the surfaces of these contact faces contribute to setting the intensity of the friction torque between these first and second parts 3*a*, 3*b*. This recess 10 is an open recess such as a groove 11*a* provided with an opening defined in this tightening face 6*a*. The opening is considered here to lie in the same plane as an external surface of the tightening face 6*a* of this first part 3*a*. Such a recess 10 extends in a longitudinal manner within this tightening face 6*a* and has a section in the shape of a half-quadrilateral, comprising two parallel walls 12*a* and a bottom 12*b*, said walls 12*a* being perpendicular or substantially perpendicular to this bottom 12*b*.

This resiliently compressible element 9 and this tightening element 8 are positioned inside this recess 10 so as to project from the tightening face 6*a* of the first part 3*a* in which this recess 10 is defined, while having a part of the body of each of these two elements 8, 9 passing through the opening of this recess 10. More specifically, the resiliently compressible element 9 and the tightening element 8 respectively have thicknesses referenced H1 and H2 in FIG. 1 which are greater than a depth P of the recess 10. Preferably, it should be noted that the thickness H2 of the tightening element 8 is greater than the thickness H1 of the resiliently compressible element 9, such that the tightening element 8 is alone in cooperating with a planar surface of the tightening face 6*b* of the second part 3*b* over all or part of the course of travel of one of the two parts 3*a*, 3*b* relative to the other during the assembly/disassembly of these two parts 3*a*, 3*b* with one another. It should be noted that the depth P of this recess 10 is, in this case, a distance defined between the opening and the bottom 12*b* of the recess 10.

In this recess 10, this resiliently compressible element 9 and the tightening element 8 are concentric or coaxial. In this configuration, it is thus understood that this resiliently compressible element 9 and the tightening element 8 each have an appreciably circular shape. Moreover, in a non-limiting manner, the resiliently compressible element 9 preferably has a diameter d1 that is greater than the diameter d2 of the tightening element 8. It should be noted that the resiliently compressible element 9 and the tightening element 8 preferably have similar shapes to those of a horizontal cross-section of the case 2, which section is perpendicular to the axis A.

As shown, the system 1 comprises a device for producing a mechanical connection 4, in particular a bayonet connection, between the first and second parts 3*a*, 3*b*. This device for producing a mechanical connection 4 comprises connecting faces 7*a*, 7*b* defined in the first and second parts 3*a*, 3*b* and contributing to ensuring the mechanical connection between the latter. In each of these two parts 3*a*, 3*b*, the connecting face 7*a*, 7*b* and the tightening face 6*a*, 6*b* are perpendicular or substantially perpendicular to one another. These connecting faces 7*a*, 7*b* respectively comprise a groove 11*a* and a tab 11*b* capable of cooperating with one another when closing/opening the case or when assembling/disassembling the first and second parts 3*a*, 3*b* with one another. In the present embodiment, the groove 11*a* is defined in the connecting face 7*a* of the first part 3*a* and the tab 11*b* in the connecting face 7*b* of the second part 3*b*. This groove 11*a* comprises an inlet via which the tab 11*b* can be inserted inside the groove 11*a* and a back capable of acting as a banking for this tab 11*b* when assembling the first and second parts 3*a*, 3*b* with one another. It should be noted that the distance separating the inlet and the bottom of this groove 11*a* defines the course of travel of the first and second parts 3*a*, 3*b* relative to one another when assembling/disassembling these two parts 3*a*, 3*b* with one another. In this context, the connecting face 7*a* of the first part 3*a* can comprise a guide portion capable of opening out into the tightening face 6*a* of this part 3*a*, this portion being intended to control the tab 11*b* towards the inlet of the groove 11*a* in particular when assembling the first and second parts 3*a*, 3*b* with one another.

Additionally, it should be noted that the interior of the groove 11*a* comprises a guide area defined on an inside wall of the groove 11*a* in order to direct the tab 11*b* such that the tightening face 6*b* of the second part 3*b* exerts a constant axial pressure on the tightening element 8 as the tab 11*b* moves within the interior of the groove 11*a* until it abuts against the bottom of this groove 11*a*. Such a guide area can further comprise retaining notches in particular contributing to securing the closing/opening of the case 2, in other words securing the assembly/disassembly of the first and second parts 3*a*, 3*b* with one another.

It is understood that, within the scope of this bayonet connection, the device for producing a mechanical connection 4 can comprise a plurality of tabs 11*b*, preferably three, and thus also a plurality of grooves 11*a*, more specifically the same number of grooves 11*a* as there are tabs 11*b* comprised in the connecting face 7*b* of the second part 3*b*. Moreover, the orientation of one of the two parts relative to the other can be defined by a specific geometrical configuration of the tab 11*b* or by the integration of a fixed banking into the groove 11*a*.

Thus, when assembling these two parts 3*a*, 3*b* and thus closing the case 2 using this closing/opening system 1, the tab 11*b* of the connecting face 7*b* of the second part 3*b* is inserted into the guide portion defined in the connecting face 7*a* of the first part 3*a* so as to be directed towards the inlet of the groove 11*a*. This insertion occurs in a substantially axial direction relative to the rotational axis A. During this insertion, the planar surface of the tightening face 6*b* of the second part 3*b* is positioned such that it is in contact with the tightening element 8. This planar surface subsequently exerts a constant stressing force driving a reduction in the thickness H2 of this tightening element 8 by a value Y (shown in FIG. 2), as soon as the tab 11*b* is engaged at the inlet of the groove 11*a*. Thereafter, a force is applied to the first or to the second part 3*a*, 3*b* in order to drive same in rotation about the rotational axis A relative to the other part 3*b*, 3*a*, preferably until this tab 11*b* abuts against the bottom of the groove 11*a*. In this context, the constant stressing force causes this tightening element 8 to become deformed as soon as the tab 11*b* is engaged at the inlet of the groove 11*a* and until the tab 11*b* abuts against the bottom of this groove 11*a*. Under these conditions, the tightening element 8 is thus capable of contributing, by cooperating with the planar surface of the corresponding tightening face 6*b*, in this case that of the second part 3*b*, to producing a friction torque between the first part 3*a*, in this case the middle part, and the second part 3*b*, the bottom, in order to configure the rotation torque required for the secure assembly/disassembly of these two parts 3*a*, 3*b* over all or part of the angular course of travel. In particular, such a tightening element 8 allows this torque to be increased by 15-20% for example relative to the torque implemented in closing/opening systems of the prior art, in particular when this tightening element 8 is made of a polymer material such as Asutane.

It should be noted that, during the displacement of this tab 11*b* from the inlet to the bottom of this groove 11*a*, i.e. over the entire course of travel stipulated hereinabove, the tightening element 8 exerts a frictional force on the surface of the tightening face 6*b* of the second part 3*b*, in order to slow the displacement of the second part 3*b* around the rotational axis A. In this embodiment, the intensity of this frictional force is constant as a result of the shape of the guide area defined on the inside wall of the groove 11*a*, which does not aim to increase the stressing force applied to the tightening element 8, but to keep it constant. It should be noted that, at the end of the course of travel, the planar surface of the tightening face 6*b* of the second part 3*b* compresses the resiliently compressible element 9 in order to prevent water infiltrations between these two parts 3*a*, 3*b*.

It goes without saying that the present invention is not limited to the example shown but that various alternatives and modifications that may be apparent to a person skilled in the art can be made thereto. In particular, other types of mechanical connections such as screwing can be implemented to assemble these first and second parts 3*a*, 3*b*.

The invention claimed is:

1. A closing/opening system for a case of a timepiece including first and second parts, the system comprising:

a device for producing a mechanical connection between the first and second parts;

a device for creating a friction torque between the first and second parts, the device for creating a friction torque including tightening faces configured to cooperate with one another when closing/opening the case and which are defined in said first and second parts;

a tightening element in one of the two tightening faces, said tightening element being configured to generate a constant friction torque during a course of travel of one of the two parts relative to the other when closing/opening the case of the timepiece, wherein the tightening face in which the tightening element is comprised includes a recess formed by two parallel walls separated by a bottom wall that is perpendicular to the parallel walls, the recess including an opening at a top of the recess and the tightening element is in contact with the bottom wall of the recess and projects outward from the opening at the top of the recess.

2. The system according to claim 1, further comprising a resiliently compressible element comprised in the same tightening face as the tightening element, said resiliently compressible element being configured to be compressed between the first and second parts.

3. The system according to claim 2, wherein the resiliently compressible element and the tightening element project from the tightening face.

4. The system according to claim 2, wherein the resiliently compressible element projects outward from the opening at the top of the recess.

5. The system according to claim 4, wherein the resiliently compressible element has a thickness that is less than a thickness of the tightening element, said thicknesses being greater than a depth of the recess.

6. The system according to claim 2, wherein the resiliently compressible element and the tightening element each have a circular shape.

7. The system according to claim 2, wherein the resiliently compressible element has a diameter that is greater than the diameter of the tightening element.

8. The system according to claim 2, wherein the resiliently compressible element and the tightening element are arranged in said tightening face such that they are concentric or coaxial to one another.

9. The system according to claim 1, wherein the device for producing a mechanical connection comprises connecting faces defined in the first and second parts and configured to ensure the mechanical connection between the first and second parts.

10. The system according to claim 9, wherein the connecting faces respectively comprise at least one groove and at least one tab configured to cooperate with one another when closing/opening the case.

11. The system according to claim 10, wherein the connecting face comprising said groove includes a guide area configured to guide the tab towards an inlet of the groove when closing the case.

12. The system according to claim 11, wherein the groove comprises said inlet and a bottom, separated by a distance defining an angular course of travel of one of the first and second parts relative to the other.

13. The system according to claim 10, wherein the groove comprises a guide area configured to direct the tab so as to cause a constant stressing force to be applied to the tightening element resulting from the cooperation of the tightening faces with one another when closing/opening the case.

14. The system according to claim 9, wherein the tightening face and the connecting face of the first or second part are perpendicular or substantially perpendicular to one another.

15. The system according to claim 2, wherein the tightening element is a ring and the resiliently compressible element is a gasket.

16. The system according to claim 2, wherein the tightening element is a ring made of a polymer and the resiliently compressible element is an O-ring.

17. The system according to claim 1, wherein the first part is a middle part and the second part is a back of the case.

18. The system according to claim 1, wherein the device for producing a mechanical connection includes a bayonet connection between the first and second parts.

19. A case of a timepiece, comprising:

the system according to claim 1.

20. A timepiece, comprising:

the case according to claim 19.

* * * * *